US007033109B2

(12) United States Patent
Russell et al.

(10) Patent No.: US 7,033,109 B2
(45) Date of Patent: Apr. 25, 2006

(54) GROUND ANCHOR DRAINAGE APPARATUS AND A METHOD OF INSTALLATION OF GROUND DRAINAGE APPARATUS

(75) Inventors: Michael Hamilton Russell, Albourne (GB); Andrew David Hawes, Aldeburgh (GB)

(73) Assignee: Platipus Anchors Holdings Limited, (GB)

( * ) Notice: Subject to any disclaimer, the term of this patent is extended or adjusted under 35 U.S.C. 154(b) by 0 days.

(21) Appl. No.: 10/462,250

(22) Filed: Jun. 16, 2003

(65) Prior Publication Data

US 2004/0213636 A1 Oct. 28, 2004

(30) Foreign Application Priority Data

Apr. 22, 2003 (GB) ..... 0309124

(51) Int. Cl.
*E02B 11/00* (2006.01)
*E21D 20/00* (2006.01)

(52) U.S. Cl. ..... 405/45; 405/259.1

(58) Field of Classification Search ..... 52/166; 405/43, 44, 49, 50, 45, 259.1, 302.4, 302.6, 405/262

See application file for complete search history.

(56) References Cited

U.S. PATENT DOCUMENTS

| | | | | |
|---|---|---|---|---|
| 3,881,319 | A * | 5/1975 | Katagiri et al. | 405/50 |
| 4,449,848 | A | 5/1984 | Juhola | |
| 4,537,527 | A * | 8/1985 | Juhola et al. | 405/50 |
| 4,582,611 | A * | 4/1986 | Wang | 210/747 |
| 4,745,979 | A * | 5/1988 | Morimoto | 173/184 |

FOREIGN PATENT DOCUMENTS

| | | |
|---|---|---|
| DE | 3728255 | 3/1989 |
| GB | 2131852 | 6/1984 |
| GB | 2131852 A * | 6/1984 |
| JP | 59217826 | 12/1984 |
| JP | 4034112 | 2/1992 |
| WO | WO 95/12712 | 5/1995 |
| WO | WO 95/12713 | 5/1995 |

* cited by examiner

*Primary Examiner*—Michael Safavi
*Assistant Examiner*—Gay Ann Spahn
(74) *Attorney, Agent, or Firm*—Luedeka, Neely & Graham, P.C.

(57) ABSTRACT

The present invention relates to ground drainage apparatus comprising a ground anchor (13) and a length of conduit (10) providing a drainage channel for water. The length of conduit (10) is secured to the ground anchor (13) in such a way that when the ground anchor (13) is driven into the ground then the length of conduit (10) is dragged through a passage in the ground formed by the ground anchor (130 with the result that when the ground anchor is installed at a desired depth then the length of conduit (10) provides a drainage channel in the ground.

30 Claims, 6 Drawing Sheets

GROUND ANCHOR DRAINAGE APPARATUS AND A METHOD OF INSTALLATION OF GROUND DRAINAGE APPARATUS

FIELD OF THE INVENTION

The present invention relates to a ground drainage apparatus, suitable for draining soils e.g. to reduce pore water pressure behind retaining walls or within clay slopes. The present invention also relates to a method of installation of ground drainage apparatus.

BACKGROUND OF THE INVENTION

It is known in the art to use drains such as Wickdrains to help drain water from soils. Such drains also increase soil strength in clay by increasing friction of slip planes and causing a reduction in the softening and lubrication of slip panels. Such drains comprise a corrugated plastic core with a geotextile sleeve. They are usually pushed vertically into the ground, up to a distance of 20 m to 30 m, typically to accelerate consolidation settlement on highways projects.

It is also known in the art to use a ground anchor attached to a cable to secure cables in ground. The ground anchor is driven into the ground using a rod and then tilted into a locked position by tensioning the cable. Examples of such ground anchors are known from WO 95/12712 and WO95/12713. Such ground anchors have specific features which enable the anchors to be driven into the ground easily, and tilted transversely of the hole such that their withdrawal from the ground is then resisted.

SUMMARY OF THE INVENTION

It is the object of the present invention to provide drainage apparatus which can be easily inserted into the ground, which provides drainage of water, and preferably also resists being pulled from the ground.

The present invention provides ground drainage apparatus comprising:

a ground anchor; and a length of conduit providing a drainage channel for water, wherein:

the length of conduit is secured to the ground anchor in such a way that when the ground anchor is driven into the ground then the length of conduit is dragged through a passage in the ground formed by the ground anchor with the result that when the ground anchor is installed at a desired depth then the length of conduit provides a drainage channel in the ground.

BRIEF DESCRIPTION OF THE DRAWINGS

Preferred embodiments of the present invention will now be described by way of example only, with reference to the accompanying drawings, in which.

DETAILED DESCRIPTION OF THE PREFERRED EMBODIMENT(S)

Figure 1:
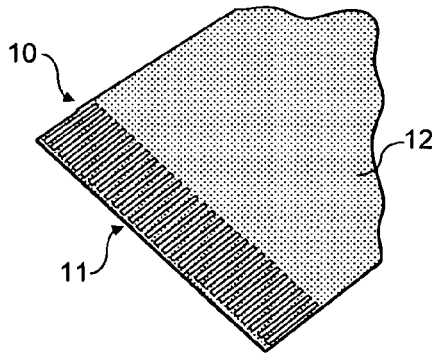
FIG. 1 is a view of a strip of Wickdrain material.

In FIG. 1 there can be seen Wickdrain 10 which comprises a strip 100 mm wide, 5 mm thick of a corrugated plastic core 11 covered by a geotextile sleeve 12. The sleeve 12 is porous so that water (but not soil) can seep through the sleeve into the core 11 and then flow along channels in the core.

Figure 2:
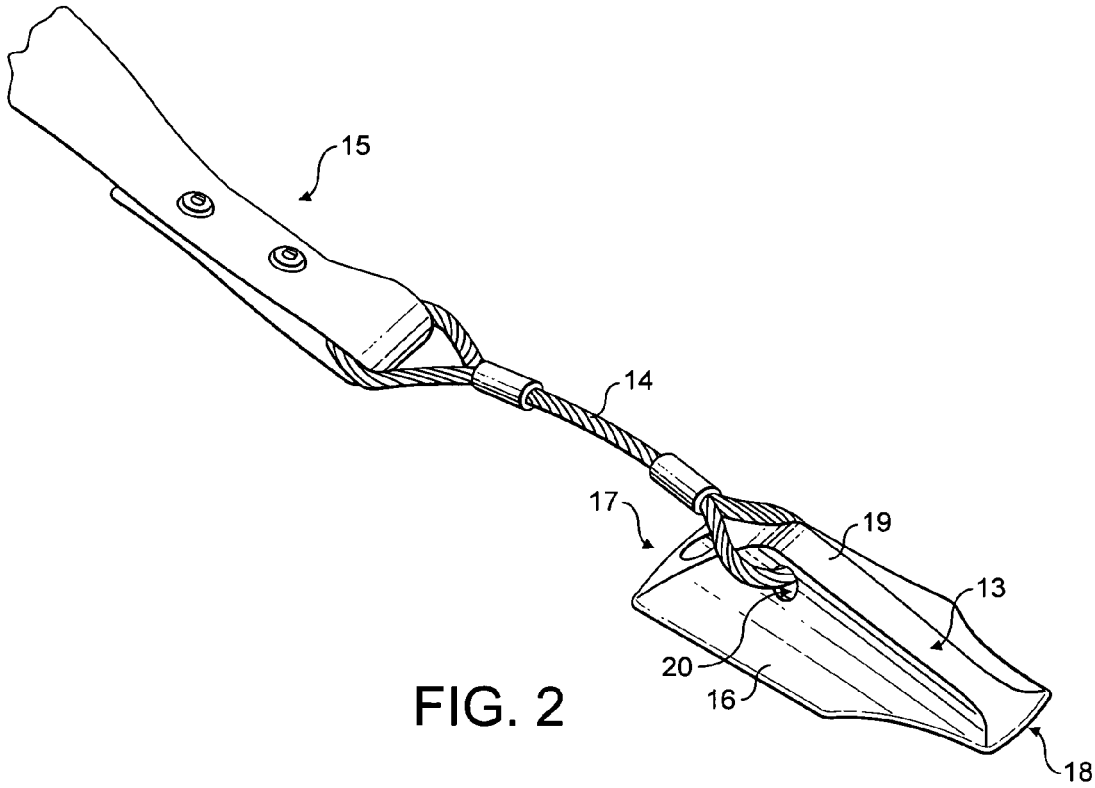
FIG. 2 is a view of a drainage apparatus according to a first embodiment of the invention.

Referring to FIG. 2, there can be seen a first type of ground anchor 13, with a connecting wire 14, and a strip 15 of Wickdrain material connected to the ground anchor 13 by the connecting wire 14.

The ground anchor 13 comprises a body portion 16 having a blind bore 17 running axially thereof for receiving a driving tool. The body portion 16 has a generally triangular cross section extending substantially along its length. The body portion has generally concave sides and a continuous convex lower surface from one edge of the body portion where the sides and lower surface meet to an opposite edge. At one end 18 of the anchor 13, i.e. the leading end as the anchor 13 is driven into the ground, the sides of the body portion meet at a flattened driving edge which may be sharpened to a chisel point. Above the central body portion is formed an anchor keel 19 in which an anchor eye 20 is formed, to which eye 20 the connecting cable 14 is attached. The high keel 19 extends from the anchor eye 20 and tapers downwardly to the driving edge 18.

One end of the connecting wire 14 is attached to the anchor 13 at the anchor eye 20, and the other end is secured to the strip 15 of drain material. The connecting wire 14 can be made from a variety of materials e.g. stainless steel or galvanised metal.

Figure 3:
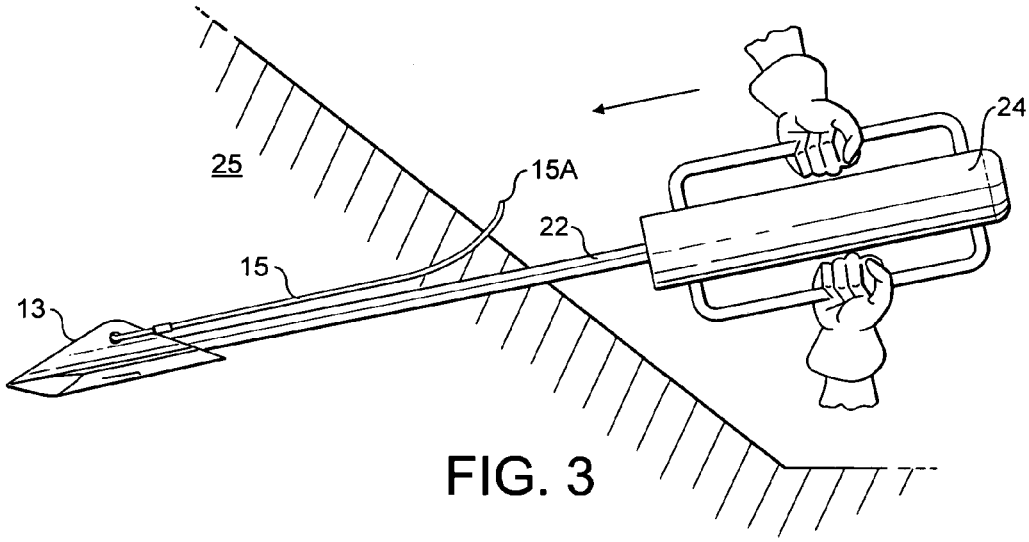
FIG. 3 illustrates a method of installation of the apparatus of FIG. 2.
Figure 4:
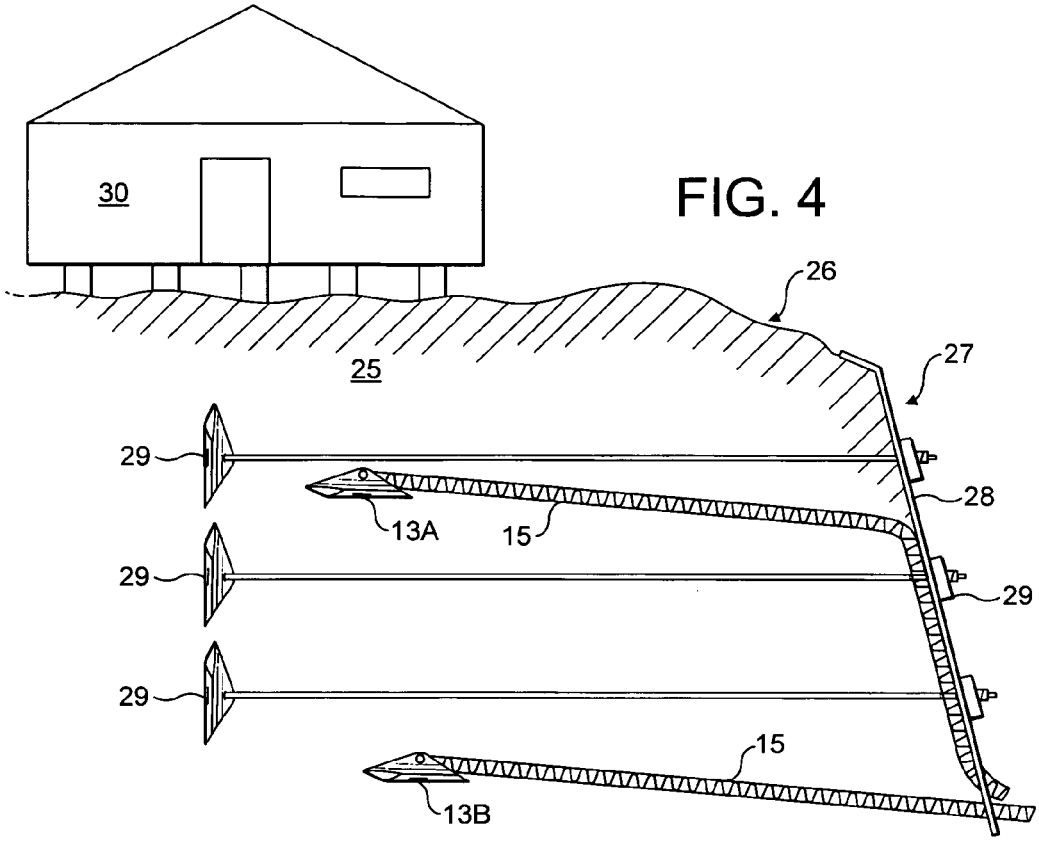
FIGS. 4 and 5 illustrate installed ground drainage apparatus of the type illustrated in FIG. 3.
Figure 5:
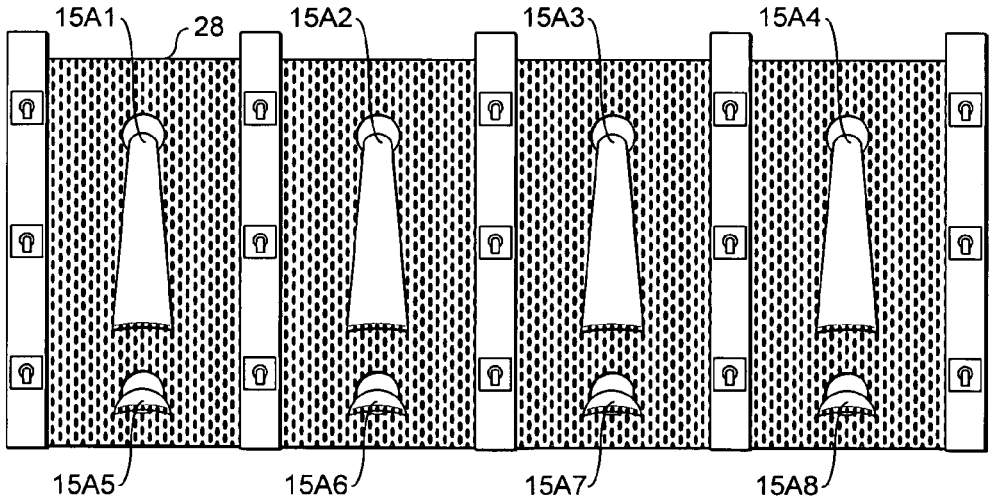

FIGS. 3, 4 and 5 show how the apparatus of FIG. 2 is used in practice. A rod 22 is inserted into the blind bore 17 in the ground anchor 13 and then a driving tool 24 is used to drive the anchor 13, via the rod 22, in a percussive manner into the soil 25, dragging behind it the strip 15 of Wickdrain material. Once the anchor 13 has been driven deep enough then the rod 22 will be removed from the anchor 13 and the soil to leave the anchor 13 in place with the strip 15 of Wickdrain material extending backwards from the anchor 13 to an end portion 15A which remains outside the soil.

FIG. 4 shows two anchors 13A and 13B in place in soil 25 which forms a bank 26 of a north facing escarpment on top of which a holiday chalet 30 is located. The escarpment is a clay slope which can move in conditions of heavy rainfall. Two rows of drainage apparatus are installed, one anchor 13A of a top row and one anchor 13B of a second lower row being shown. The anchors are installed 6 m into the soil, using the technique illustrated in FIG. 3, with four anchors in each row with 2 m horizontal spacing.

In FIG. 4 the ends of the strips of Wickdrain material can be seen labelled 15A1 to 15A8. The top row of strip ends 15A1 to 15A4 are each 1.5 m long and draped down the face of the escarpment 26. The ground anchors 13A and 13B are driven in at an angle to the horizontal so that these strips 16 of Wickdrain material in the soil are each inclined at 15° to the horizontal. The face 27 of the escarpment 26 is covered with a mesh 28 held in place by load plates 29 used in a conventional fashion. The strip ends 15A1 to 15A8 are all secured under the mesh 28. With the illustrated installation water flows from out of the clay soil 25 through the Wickdrain material to the front face 27 of the escarpment where it drains away. This improves the strength and stability of the escarpment 26, by reducing the pore water pressure behind the mesh.

Figure 6:
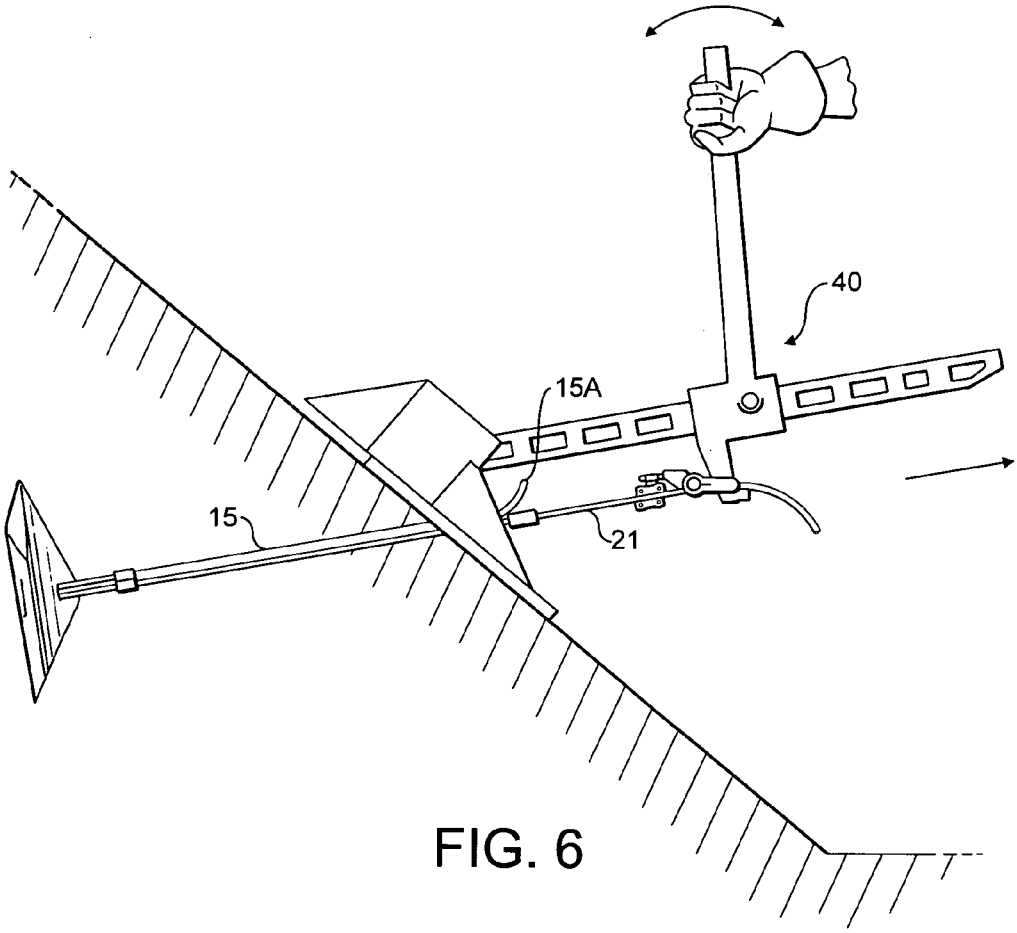
FIG. 6 illustrates an additional step to the method of installation of FIG. 3 for the variant of the FIG. 2 apparatus which is illustrated in FIG. 7.
Figure 7:
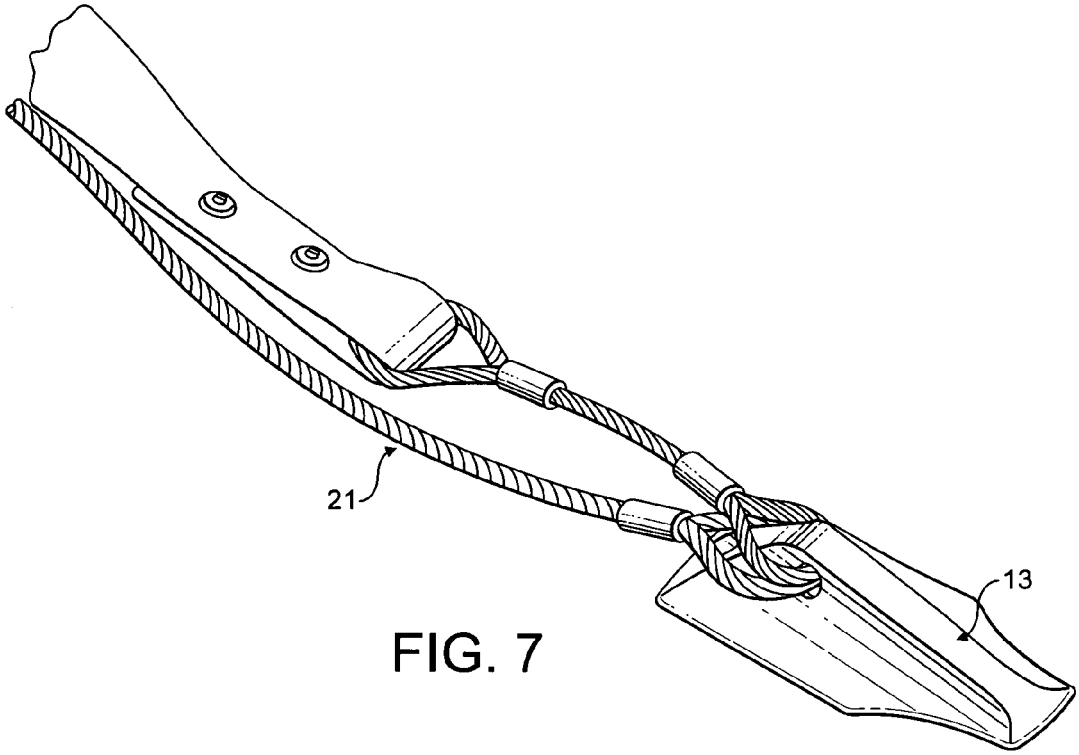
FIG. 7 is a view of a variant of the FIG. 2 apparatus.

A variant of the ground drainage apparatus and method of installation of the previous figures is shown in FIGS. 6 and 7. In FIG. 7 it can be seen that the ground anchor 13 is provided with an additional steel tendon 21. The ground anchor is driven into the ground as previously described and the driving rod removed. Then the tendon 21 is used to tilt the ground anchor 13 into a locked position as shown in FIG. 6 using a stressing jack 40. The tendon is then secured in position using a load plate (not shown). Even though the Wickdrain strip 15 is crushed in part as the ground anchor 13 is loadlocked the strip remains sufficiently intact to function.

Figure 8:
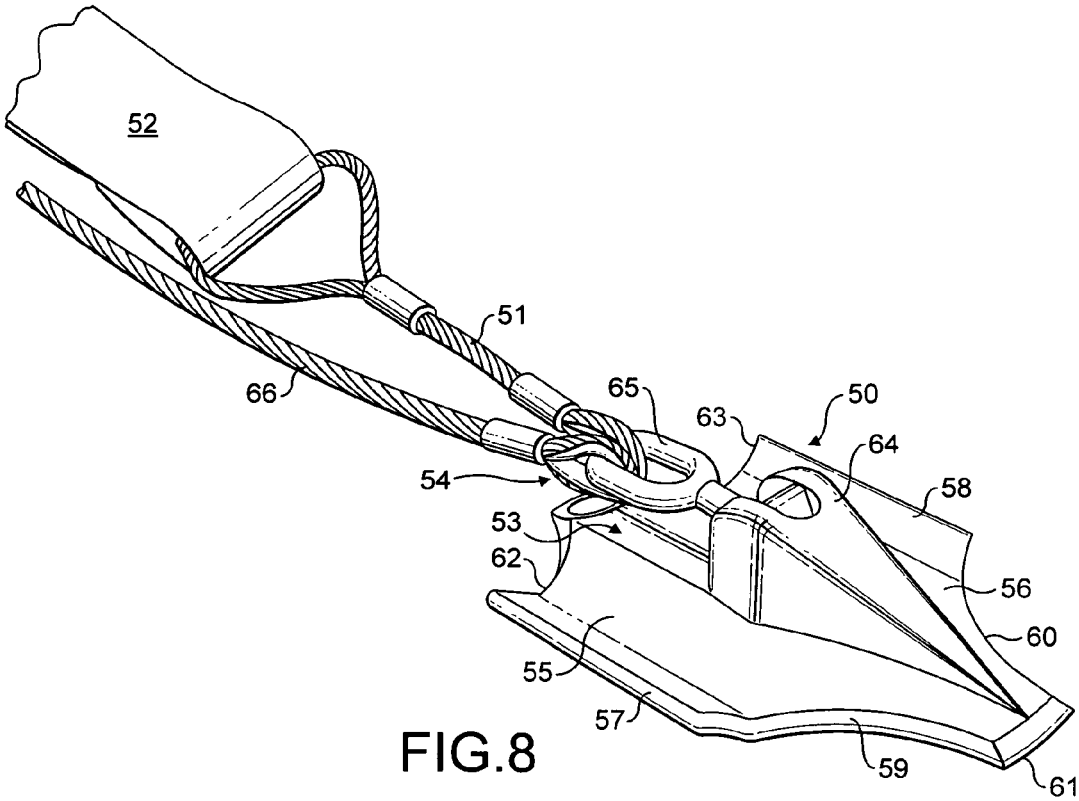
FIG. 8 is a view of drainage apparatus according to a second embodiment of the invention.

Referring to FIG. 8, there can be seen a further embodiment of drainage apparatus comprising a different ground anchor 50, attached via a stainless steel connecting wire 51 to a strip 52 of Wickdrain material. The anchor 50 is made of cast spheroidal graphite iron (although it could be made of other materials) and comprises a central body portion 53 having a blind bore 54 running axially thereof for receiving a driving tool. Projecting from each side of the body portion is a wing 55,56. These wings 55,56 project downwardly at an angle to a horizontal plane through the anchor. At the side edges of the wings 55,56 are angled winglets 57,58 which project upwardly at an angle to the plane of the wings 55,56 so that in transverse cross-section the anchor is W-shaped. The edges of the angled winglets 57,58 are provided with rounded edge beads.

At one end 67 of the anchor 50, i.e. the leading end as the anchor is driven into the ground, the wings 55,56 meet at a flattened driving edge 61 which may be sharpened to a chisel point. The leading wing edges 59,60 which connect to the driving edge 61 may also be sharpened.

At an opposite end of the anchor 50, i.e. the trailing end as the anchor 50 is driven into the ground, the trailing edges 62,63 of the wings 55,56 may curve gently in an upwardly direction. At the trailing end of the anchor, the body portion 53 has a sloping nose.

Above the central body portion is formed an anchor keel 64 in which an anchor eye 65 is pivotally mounted. The high keel as it extends from the point of pivotal attachment of the anchor eye 65 tapers downwardly to the driving edge 61. It may also taper in a horizontal plane to form a point adjacent the driving edge 61.

As can be seen in FIG. 8, the connecting wire 51 is secured to the anchor eye 65. Additionally secured to the anchor eye 65 is a steel tendon 66.

Figure 9:
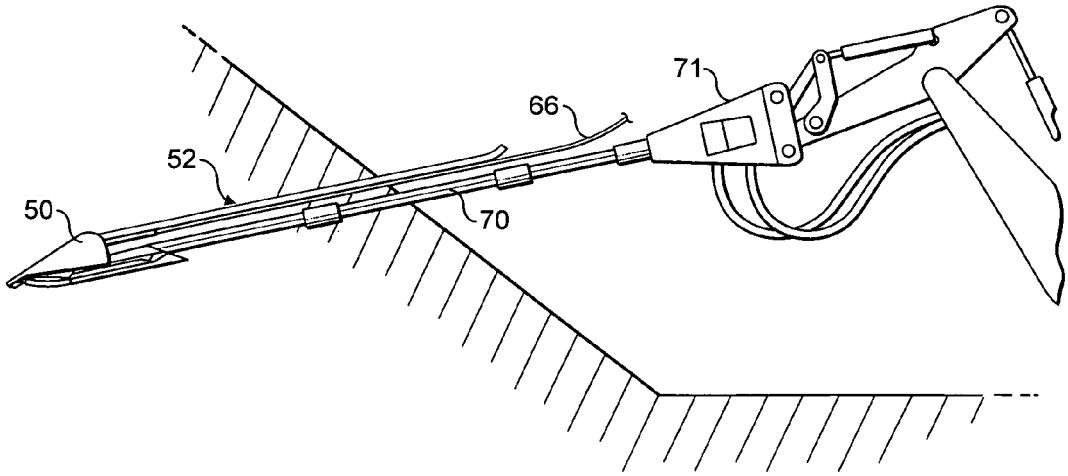
FIGS. 9 and 10 illustrate a method of installation of the apparatus of FIG. 8.
Figure 10:
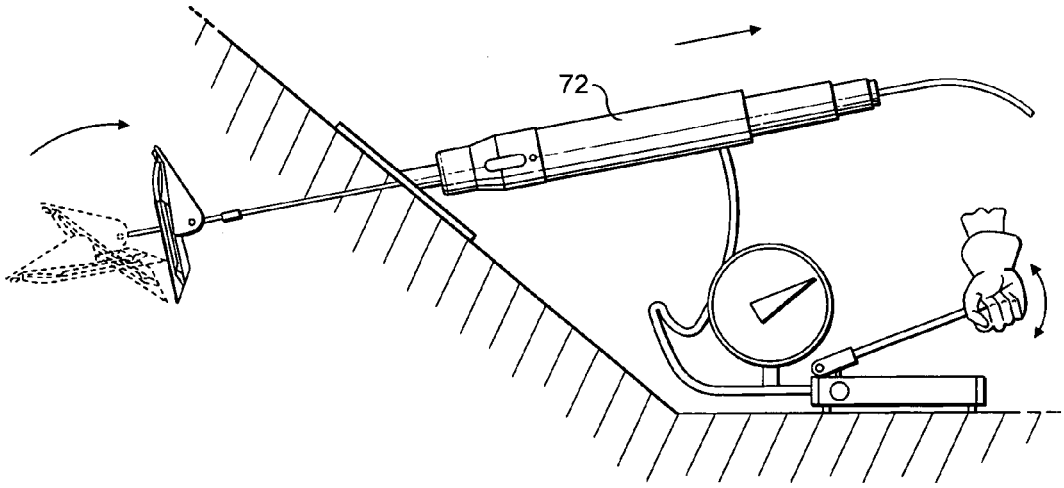

The FIGS. 9 and 10 show how the anchor 50 can be driven into place and locked in position. A driving rod 70 is inserted into the blind bore 54 and then a pneumatic (or hydraulic) jackhammer 71 is used to percussively hammer the anchor 50 to a desired depth.

The strip 52 of Wickdrain material is dragged into the ground following the anchor 50 since it is attached by the connecting cable 51. The use of the anchor 50 facilitates the entry of the drainage strip into the ground.

At the desired depth, the drive rod 70 is removed from the bore. The anchor is rotated substantially 90 degrees into a locked position by applying a pulling force to the tendon 66, using a hydraulic jack 72 (see FIG. 10). Once the sharp nose of the body 65 bites the back of the hole, this forms a fulcrum for the anchor 50 to turn about. This process of locking the anchor may crush the Wickdrain material partially, however this does not substantially affect the performance of the drain.

Figure 11:
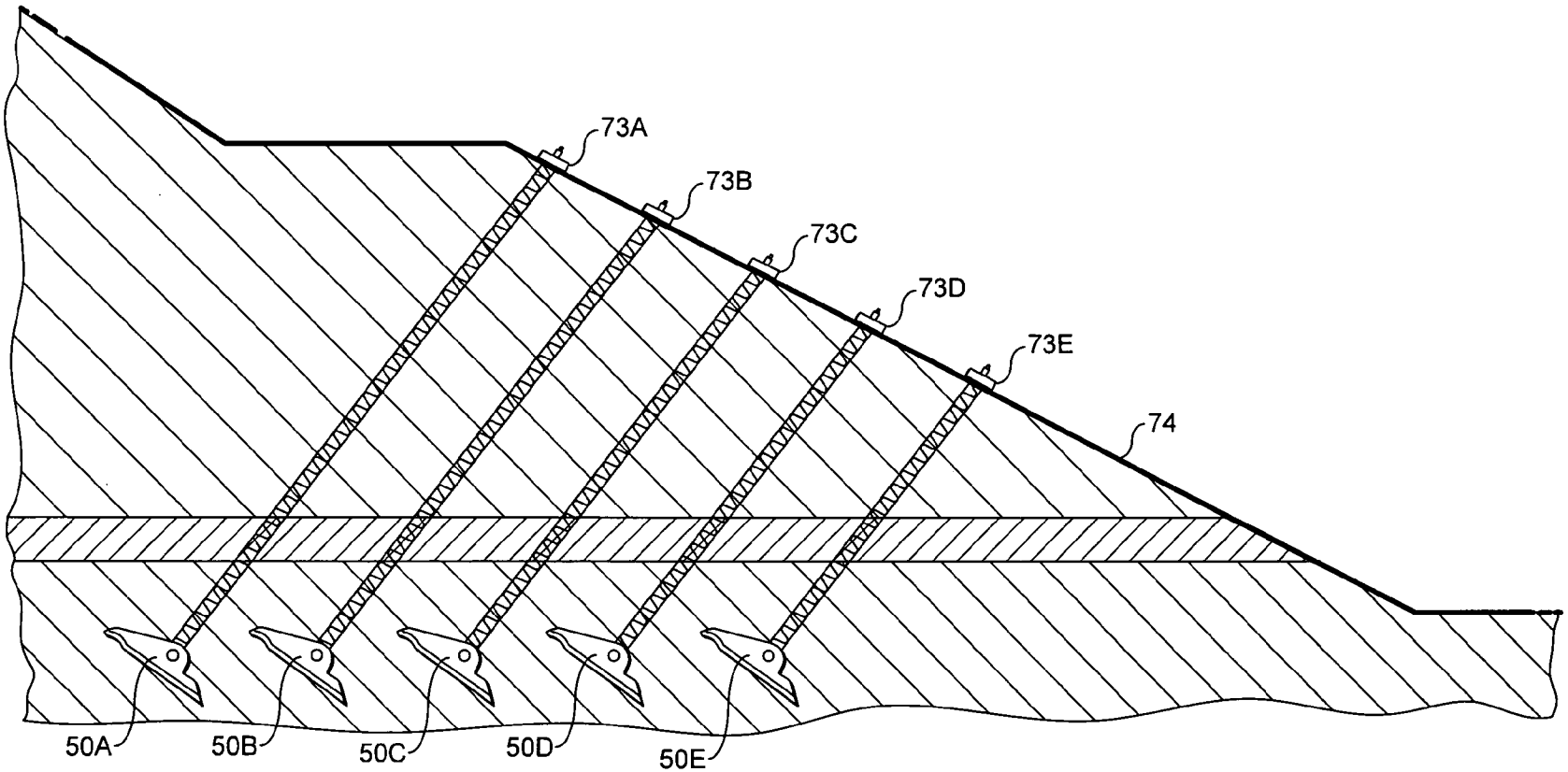
FIG. 11 illustrates installed ground drainage apparatus of the type illustrated in FIG. 8.

Use of anchors 50 is illustrated in FIG. 11. In the figure there can be seen a deep highway cutting in fully saturated boulder clay at risk of movement, due to both rotational slip through the boulder clay and plane shear through the laminated clay. The situation is improved by the installation of ground drainage apparatus according to the present invention. In the Figure there can be seen a row of five ground anchors 50A to 50E. The anchors 50A to 50C are driven to an 8 m deep installation depth at a 45° to the horizontal. The anchors 50D and 50E are driven to a 6 m deep installation depth again at an angle of 45° to the horizontal. The anchors are all driven to the required depths by the method described with reference to FIGS. 9 and 10. The free ends of the strips 52A–52E of Wickdrain material are secured in place using load plates 73A to 73E to which the steel tendons (not separately shown) secured to the anchors 50A to 50E are also secured. The load plates also hold in place a geotextile covering 74 along the face of the cutting. There will be a plurality of horizontally spaced rows of five ground anchors identical to the illustrate row extending along the cutting.

The geology of the site illustrated in FIG. 11 permits the drainage solution shown. The boulder clay sits on a layer of laminated clay which in turn sits on a bed of sand and gravel. The ground anchors 50A–E are used to perforate the laminated clay layer so that the strips of Wickdrain can drain water out of the boulder clay through the laminated clay to the sand and gravel bed beneath where the water can be dispersed. Advantageously, the sand and gravel bed also provides high bearing capacities for the ground anchor, typically 10 times greater than the bearing capacities of the anchors in boulder clay. In the illustrated solution the ground drainage apparatus not only stabilises the boulder clay by draining the clay of water but also the clay is held in place by tension in the steel tendons extending between the anchors 50A–E and the load plates 73A–E.

The ground anchors used in the preferred embodiments may be made from any suitable material depending on use, such as iron/steel, brass and copper based alloys, aluminium and possibly non-metallic materials. The connecting wire is preferably made of galvanised or stainless steel or other material of sufficient strength and corrosion resistance. Whilst the illustrated strips of drainage material are all strips of Wickdrain, strips of other materials could be used. For instance it is known in the field of drainage to provide simple perforated plastic tubing without a geotextile covering.

What is claimed is:

1. Ground drainage apparatus comprising:

a ground anchor;

a rod for driving the ground anchor into the ground; and a length of conduit providing a drainage channel for water, wherein:

the ground anchor has socket means in which an end of the rod can be located whereby the ground anchor can be driven into the ground using the rod with the rod then withdrawn from the ground leaving the ground anchor in place at a desired depth; and the ground anchor has a connecting wire spaced apart from the socket means, the connecting wire securing the length of conduit to the ground anchor in spaced apart relationship to the rod when the ground anchor is driven into the ground so that the length of conduit is dragged through a passage in the ground formed by the ground anchor lying alongside, external to and separate from the rod, such that when the rod is withdrawn from the ground and the ground anchor is installed at a desired depth then the length of conduit provides a drainage channel in the ground.

2. Ground drainage apparatus as claimed in claim 1 comprising additionally a tendon connected to the ground anchor, wherein the tendon can be dragged through the passage in the ground formed by the ground anchor as the ground anchor is driven to the desired depth and the tendon can be used to pivot the ground anchor to a locked position in the ground by exerting a tensile force on an end part of the tendon which remains above ground when the ground anchor is at the desired depth.

3. Ground drainage apparatus as claimed in claim 2 comprising additionally a load plate to which the tendon is attached once the ground anchor has been pivoted to the locked position thereof so that the tendon can be placed in tension in order that a tensile force is applied to both the ground anchor and the load plate.

4. Ground drainage apparatus as claimed in claim 1 wherein the length of conduit comprises a corrugated plastic core surrounded by a porous fabric sleeve.

5. Ground drainage apparatus as claimed in claim 4 wherein the porous fabric sleeve is made of a geotextile material.

6. Ground drainage apparatus as claimed in claim 2 wherein the length of conduit comprises a corrugated plastic core surrounded by a porous fabric sleeve.

7. Ground drainage apparatus as claimed in claim 6 wherein the porous fabric sleeve is made of a geotextile material.

8. Ground drainage apparatus as claimed in claim 3 wherein the length of conduit comprises a corrugated plastic core surrounded by a porous fabric sleeve.

9. Ground drainage apparatus as claimed in claim 8 wherein the porous fabric sleeve is made of a geotextile material.

10. A method of installing the ground drainage apparatus claimed in claim 1, the method comprising:

engaging the rod in the socket means of the ground anchor and using the rod to drive the ground anchor into the ground to the desired depth, with the ground anchor dragging the length of conduit through the passage in the ground formed by the ground anchor with the length of conduit lying alongside, external to and separate from the rod;

withdrawing the rod from the ground; and leaving the length of conduit in situ to form a drainage channel in the ground.

11. A method of installing ground drainage apparatus as claimed in claim 10, the method comprising:

driving of the ground anchor through a soil type liable to water saturation in to a soil type therebeneath which permits water drainage; whereby:

the length of conduit forms a drainage channel extending from the ground anchor and the soil type which permits drainage back into the soil type liable to water saturation whereby water can drain downwardly from the soil type liable to water saturation into the soil type beneath which permits drainage.

12. A method as claimed in claim 10 wherein:

the ground anchor once driven to the desired depth is rotated from a driving orientation thereof to a locked orientation thereof using a tendon attached to the ground anchor which is dragged behind the earth anchor as the earth anchor is driven into the ground.

13. A method as claimed in claim 12 wherein:

an end of the tendon is secured to a load plate and the tendon is tensioned to exert a force both on the ground anchor and the load plate.

14. A method as claimed in claim 11, wherein:

the ground anchor once driven to the desired depth is rotated from a driving orientation thereof to a locked orientation thereof using a tendon attached to the ground anchor which is dragged behind the earth anchor as the earth anchor is driven into the ground.

15. A method as claimed in claim 14 wherein:

an end of the tendon is secured to a load plate and the tendon is tensioned to exert a force both on the ground anchor and the load plate.

16. A method of installing the ground drainage apparatus claimed in claim 2, the method comprising:

engaging the rod in the socket means of the ground anchor and using the rod to drive the ground anchor into the ground to the desired depth, with the ground anchor dragging the length of conduit through the passage in the ground formed by the ground anchor with the length of conduit lying alongside, external to and separate from the rod;

withdrawing the rod from the ground; and leaving the length of conduit in situ to form a drainage channel in the ground.

17. A method of installing ground drainage apparatus as claimed in claim 16, the method comprising:

driving of the ground anchor through a soil type liable to water saturation into a soil type therebeneath which permits water drainage;

whereby:

the length of conduit forms a drainage channel extending from the ground anchor and the soil type which permits drainage back into the soil type liable to water saturation whereby water can drain downwardly from the soil type liable to water saturation into the beneath soil type which permits drainage.

18. A method as claimed in claim 16 wherein:

the ground anchor once driven to the desired depth is rotated from a driving orientation thereof to a locked orientation thereof using a tendon attached to the ground anchor which is dragged behind the earth anchor as the earth anchor is driven into the ground.

19. A method as claimed in claim 18, wherein:

an end of the tendon is secured to a load plate and the tendon is tensioned to exert a force both on the ground anchor and the load plate.

20. A method as claimed in claim 17 wherein:

the ground anchor once driven to the desired depth is rotated from a driving orientation thereof to a locked orientation thereof using a tendon attached to the ground anchor which is dragged behind the earth anchor as the earth anchor is driven into the ground.

21. A method as claimed in claim 20 wherein:

an end of the tendon is secured to a load plate and the tendon is tensioned to exert a force both on the ground anchor and the load plate.

22. A method of installing the ground drainage apparatus claimed in claim 3, the method comprising:

engaging the rod in the socket means of the ground anchor and using the rod to drive the ground anchor into the ground to the desired depth, with the ground anchor dragging the length of conduit through the passage in the ground separated from the ground anchor with the length of conduit lying alongside external to and alongside the rod;

withdrawing the rod from the ground; and leaving the length of conduit in situ to form a drainage channel in the ground.

23. A method of installing the ground drainage apparatus claimed in claim 22, the method comprising:

driving of the ground anchor through a soil type liable to water saturation into a soil type therebeneath which permits water drainage; and whereby:

the length of conduit forms a drainage channel extending from the ground anchor and the soil type which permits drainage back into the soil type liable to water saturation whereby water can drain downwardly from the soil type liable to water saturation into the beneath soil type which permits drainage.

24. A method as claimed in claim 22 wherein:

the ground anchor once driven to the desired depth is rotated from a driving orientation thereof to a locked orientation thereof using a tendon attached to the ground anchor which is dragged behind the earth anchor as the earth anchor is driven into the ground.

25. A method as claimed in claim 24, wherein:

an end of the tendon is secured to a load plate and the tendon is tensioned to exert a force both on the ground anchor and the load plate.

26. A method as claimed in claim 23, wherein:

the ground anchor once driven to the desired depth is rotated from a driving orientation thereof to a locked orientation thereof using a tendon attached to the ground anchor which is dragged behind the earth anchor as the earth anchor is driven into the ground.

27. A method as claimed in claim 26 wherein:

an end of the tendon is secured to a load plate and the tendon is tensioned to exert a force both on the ground anchor and the load plate.

28. A method of installing ground drainage apparatus as claimed in claim 10, wherein:

the ground anchor is driven into the ground from a face of a slope at an angle to the horizontal and to a desired depth in the ground from the slope face.

29. A method of installing ground drainage apparatus as claimed in claim 16, wherein:

the ground anchor is driven into the ground from a face of a slope at an angle to the horizontal and to a desired depth in the ground from the slope face.

30. A method as claimed in claim 22, wherein the ground anchor is driven into the ground from a face of a slope at an angle to the horizontal and to a desired depth in the ground from the slope face.

* * * * *